US006782798B2

(12) United States Patent
Ahn

(10) Patent No.: US 6,782,798 B2
(45) Date of Patent: Aug. 31, 2004

(54) COUPLING STRUCTURE OF DRIVE SHAFT TO SWASH PLATE ASSEMBLY IN VARIABLE CAPACITY SWASH PLATE TYPE COMPRESSOR

(75) Inventor: Hewnam Ahn, Daejeon (KR)

(73) Assignee: Halla Climate Control Corporation, Daejeon-Si (KR)

( * ) Notice: Subject to any disclaimer, the term of this patent is extended or adjusted under 35 U.S.C. 154(b) by 124 days.

(21) Appl. No.: 10/316,813

(22) Filed: Dec. 11, 2002

(65) Prior Publication Data

US 2003/0108433 A1 Jun. 12, 2003

(30) Foreign Application Priority Data

Dec. 12, 2001 (KR) ..... 10-2001-0078485

(51) Int. Cl.[7] ..... F01B 3/00
(52) U.S. Cl. ..... 92/12.2; 92/71
(58) Field of Search ..... 92/12.2, 71; 91/499; 417/222.2

(56) References Cited

U.S. PATENT DOCUMENTS 5,239,913 A * 8/1993 Terauchi ..... 92/12.2
5,850,775 A * 12/1998 Stiefel ..... 92/12.2
5,980,216 A * 11/1999 Tokumasu ..... 92/12.2

FOREIGN PATENT DOCUMENTS

JP 6307333 11/1994
JP 8014157 1/1996
JP 11125176 4/1999

* cited by examiner

*Primary Examiner*—Edward K. Look
*Assistant Examiner*—Michael Leslie
(74) *Attorney, Agent, or Firm*—Fulbright & Jaworski L.L.P.

(57) ABSTRACT

Disclosed is a coupling structure between a drive shaft and a swash plate assembly in a variable capacity swash plate type compressor, which is so modified that the rotating force of the drive shaft can be transferred to a rotor and the swash plate assembly by substantially equal amounts so as to prevent the frictional of a driving unit as well as prolong life time. In a variable capacity swash plate type compressor which rotates the swash plate assembly, which is hingeably coupled to one side of a rotor in such a manner that its inclination angle is adjustable, under the rotating force of the drive shaft to reciprocate a piston within a cylinder bore, the coupling structure comprises: the swash plate assembly which includes a drive shaft through-hole for passage of the drive shaft, a hub having a boss with a plurality of pin holes on the outer circumferential surface thereof, and a plate coupled to the outer periphery of the boss and having the piston mounted thereon; the drive shaft which includes a plurality of slots formed thereon in an axial direction corresponding to the pin holes of the hub, the slots communicating and intersecting with each other; and a plurality of coupling pins inserted into the pin holes and the corresponding slots to couple the swash plate to the drive shaft.

5 Claims, 5 Drawing Sheets

Prior Art

Prior Art

COUPLING STRUCTURE OF DRIVE SHAFT TO SWASH PLATE ASSEMBLY IN VARIABLE CAPACITY SWASH PLATE TYPE COMPRESSOR

BACKGROUND OF THE INVENTION

1. Field of the Invention

The present invention relates to a coupling structure of a drive shaft to a swash plate assembly in a variable capacity swash plate type compressor.

2. Background of the Related Art

A compressor in an air conditioner for vehicles selectively receives power transmitted via an engine crank pulley from an engine in order to suck in heat-exchanged refrigerant from an evaporator, compress refrigerant through linear reciprocating motion of a piston and then discharge refrigerant to a condenser.

In the variable capacity swash plate type compressor, an example of the prior art is disclosed in Korean Utility Model Registration No.2002-28619 published on Apr. 17, 2002.

As shown in FIGS. 1 and 2, a swash plate assembly 10 has a hub 11 and a swash plate 15. The hub 11 has a boss 12 with a drive shaft through-hole 13 for passage of a drive shaft 20. The through-hole 13 has angular and substantially rectangular inner surfaces defined by first vertical and horizontal sections 16 and 14. The boss 12 has a single pin hole 12*a* intersecting perpendicular with the through-hole 13 for the drive shaft.

The swash plate 15 has a coupling hole 15*a* coupled to an outer periphery of the hub 11, and a piston 40 is coupled to an edge of the swash plate 15 as shown in FIG. 1.

In the meantime, in the drive shaft through-hole 13 of the boss 12, the drive shaft 20 has outer surfaces defined by second vertical and horizontal sections 21 and 22 configured substantially identical with the inner surfaces of the drive shaft through-holes 13.

The second vertical section 22 of the drive shaft 20 has a single slot 23 in the axial direction for allowing slidable motion of a coupling pin 30 which is inserted through the pin hole 12*a* in the boss 12.

According to a conventional configuration of the drive shaft coupled to the swash as set forth above, the hub 11 is supported by the drive shaft 20 via coupling of the coupling pin 30 so that the rotation center of the swash plate assembly 10 moves along the drive shaft 20 without variation.

The drive shaft 20 has the slot 23 in the longitudinal direction, which is coupled to the coupling pin 30 which is supported by the boss 12 of the hub 11 so that the coupling pin 30 moves along the slot 23 as the inclination angle of the swash plate assembly 10 increases.

Therefore the hub 11 moves while pivoting along the drive shaft 20 without any variation of rotation center.

However, the prior art of the above construction has disadvantages as follows.

First, in order to minimize bending moment applied to the single coupling pin 30 when the rotary torque of the drive shaft 20 is transferred to the hub 11 of the swash plate assembly 10, and allow the inner surfaces of the drive shaft through-hole 13 to have a configuration capable of accepting the variation in inclination angle of the swash plate assembly 10 in respect to the drive shaft 20, and to stably support the drive shaft 20 in the angle-varied inclination position of the swash plate assembly 10, the drive shaft through-hole 13 has a substantially rectangular internal cross section and the drive shaft 20 partly has a substantially rectangular external cross section corresponding to the internal cross section of the drive shaft through-hole 13 to be inserted into the drive shaft through-hole 13. However, the prior art has drawbacks in that the cross sections of the drive shaft through-hole 13 and the drive shaft 20 are additionally formed into the rectangular ones and the swash plate assembly must be precisely processed in terms of an inclination angle of the swash plate assembly 10.

Second, the second vertical and horizontal sections 21 and 22 of the drive shaft 20 frictionally contact with the second vertical the first section 16 of the hub 11 by a large amount thereby poorly carrying out the variation in inclination angle of the swash plate assembly 10.

Third, the swash plate 15 of the swash plate assembly 10 is frequently twisted owing to compressive load of the piston 40 during actuation of the compressor. However, since this twist is not fundamentally prevented, it is impossible to vary the inclination angle of the swash plate in a more stable manner.

In the meantime, in the above variable capacity swash type compressor, other examples of the prior art include Japanese Patent Laid-open Publication No. Hei6-307333 published on Nov. 1, 1994 and Japanese Patent Laid-open Publication No. Hei8-14157 published on Jan. 16, 1996.

Even though the above other examples of the prior art are not illustrated in the drawings, they have constructions each having a single slot for insertably receiving a single coupling pin so that the coupling pin can shift.

However, these examples of the prior art also produce the second disadvantage according to the first example of the prior art.

SUMMARY OF THE INVENTION

The present invention has been made to solve the foregoing problems and it is therefore an object of the present invention to provide a coupling structure between a drive shaft and a swash plate assembly in a variable capacity swash plate type compressor, which is so modified that the rotating force of the drive shaft can be transferred to a rotor and the swash plate assembly by substantially equal amounts so as to prevent the frictional of a driving unit as well as prolong life time.

According to an aspect of the invention to obtain the above objects, it is provided a coupling structure between a drive shaft and a swash plate assembly in a variable capacity swash plate type compressor which rotates the swash plate assembly, which is hingeably coupled to one side of a rotor in such a manner that its inclination angle is adjustable, under the rotating force of the drive shaft to reciprocate a piston within a cylinder bore, the coupling structure comprising: the swash plate assembly which includes a drive shaft through-hole for passage of the drive shaft, a hub having a boss with a plurality of pin holes on the outer circumferential surface thereof, and a plate coupled to the outer periphery of the boss and having the piston mounted thereon; the drive shaft which includes a plurality of slots formed thereon in an axial direction to correspond to the pin holes of the hub, the slots communicating and intersecting with each other; and a plurality of coupling pins inserted through the pin holes and the corresponding slots to couple the swash plate to the drive shaft.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

The following detailed description will present a coupling structure between a drive shaft and a swash plate assembly in a variable capacity swash type compressor according to a preferred embodiment of the invention in reference to the accompanying drawings.

Figure 1:
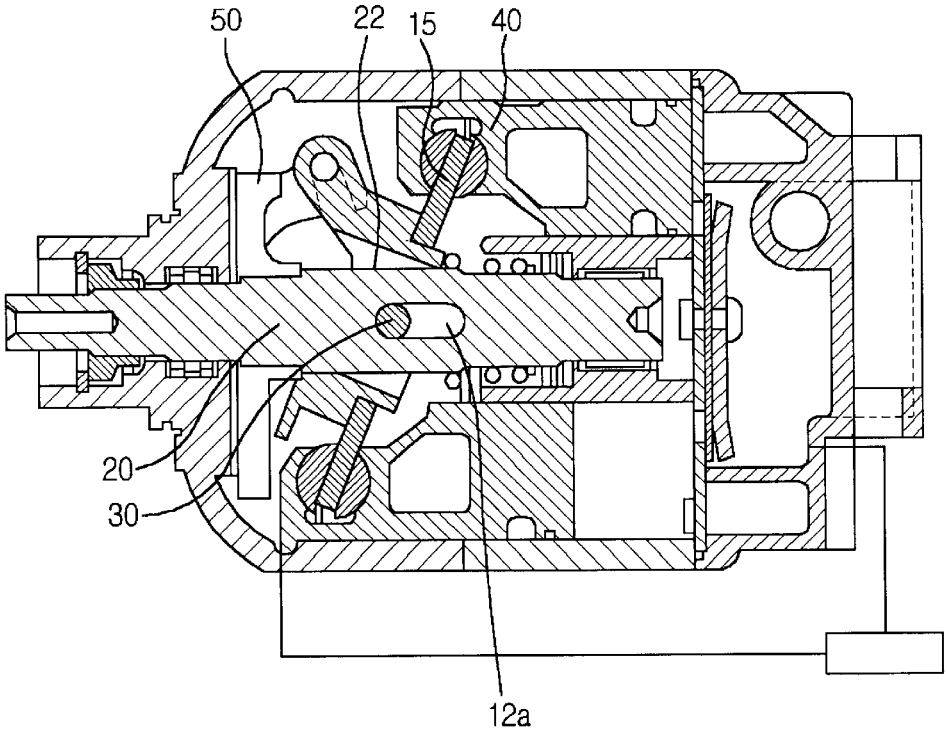
FIG. 1 is a sectional view of a variable capacity swash type compressor of the prior art.
Figure 2:
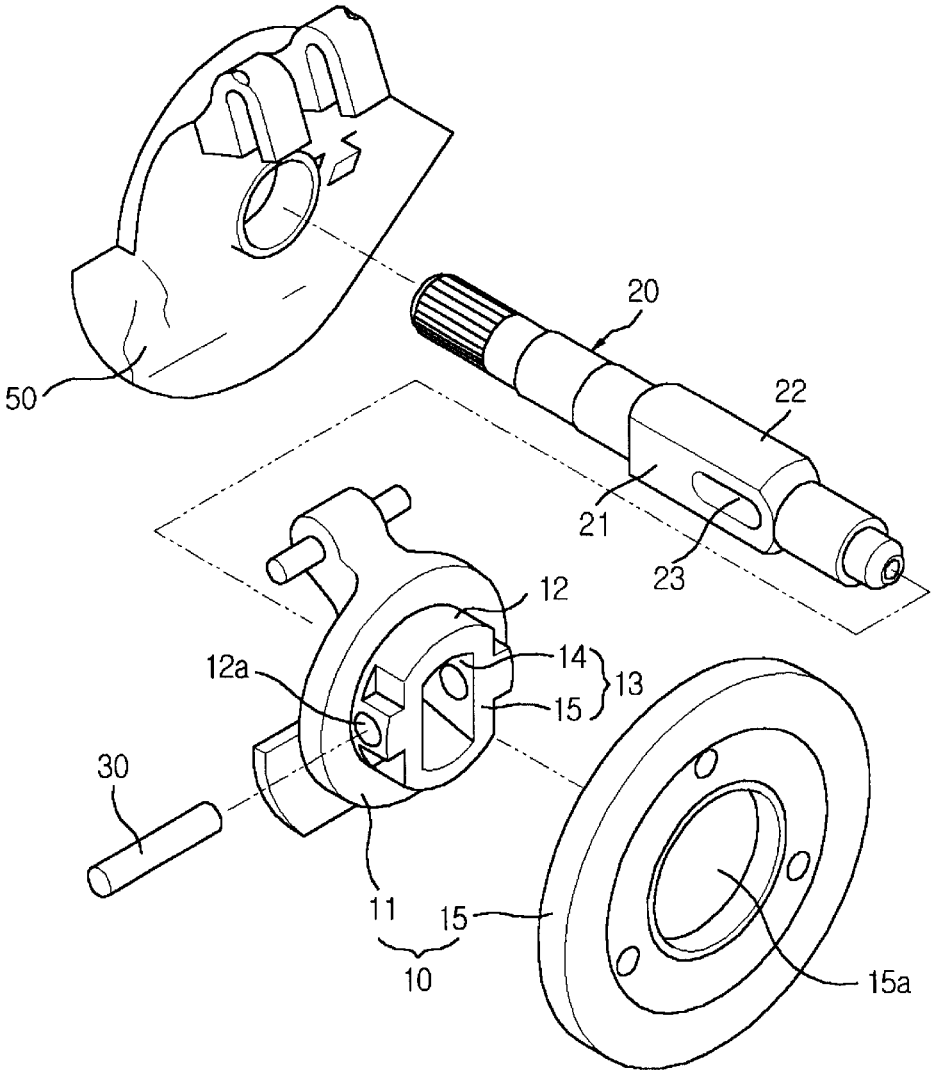
FIG. 2 is an exploded perspective view illustrating a coupling relation between a drive shaft and a swash plate assembly shown in FIG. 1.
Figure 3:
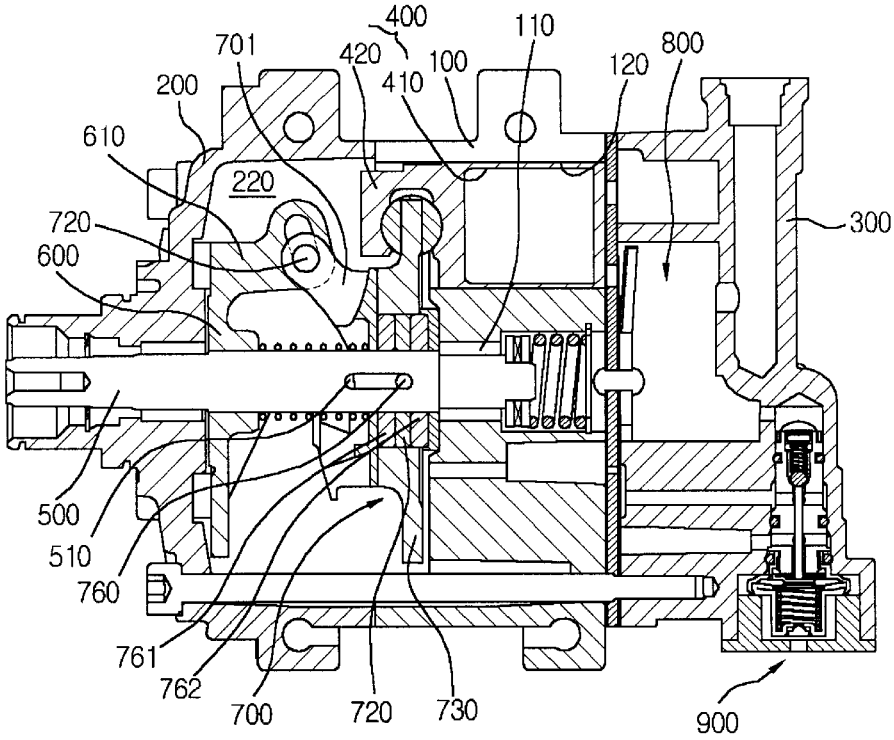
FIG. 3 is a sectional view illustrating an internal structure of a variable capacity swash type compressor of the invention.
Figure 4:
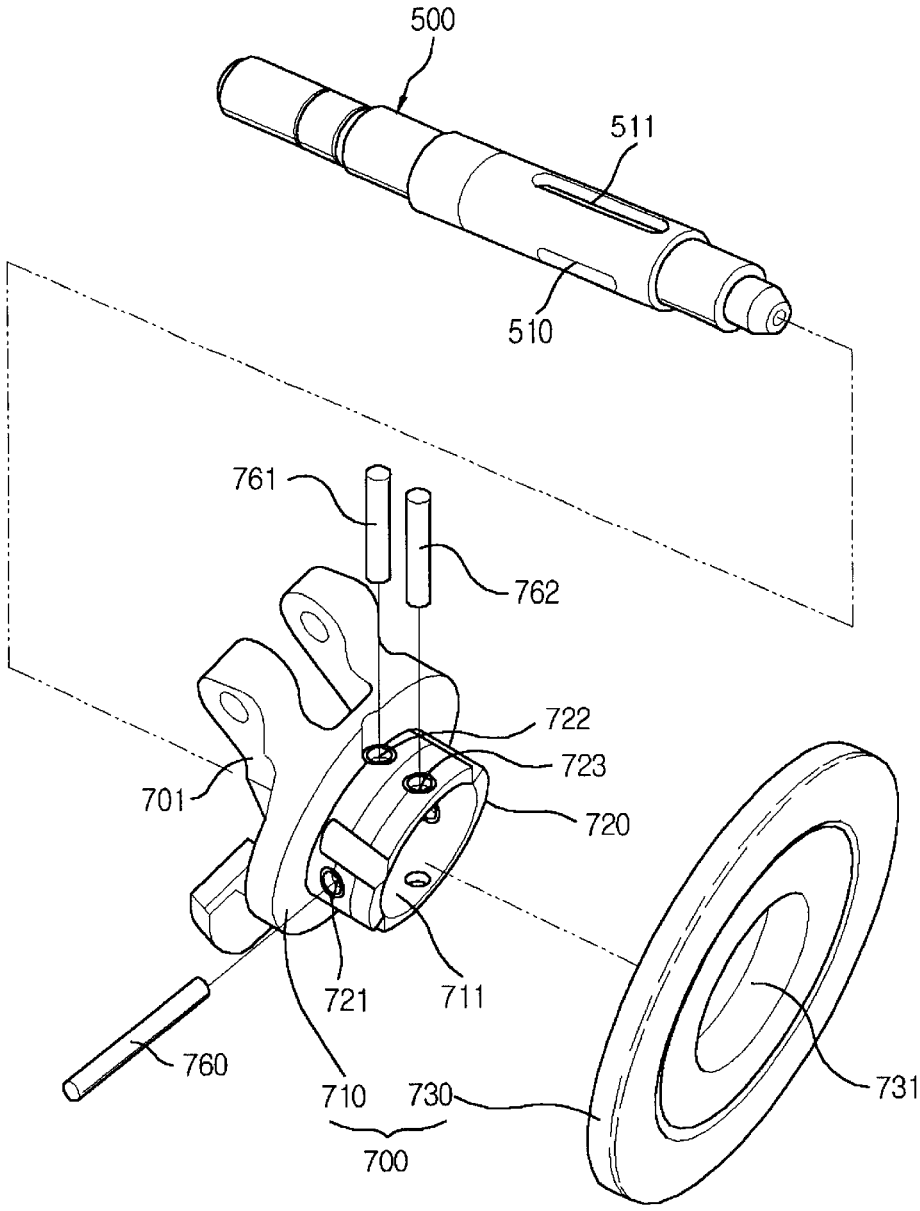
FIG. 4 is an exploded perspective view illustrating a coupling relation between a drive shaft and a swash plate assembly shown in FIG. 3.
Figure 5:
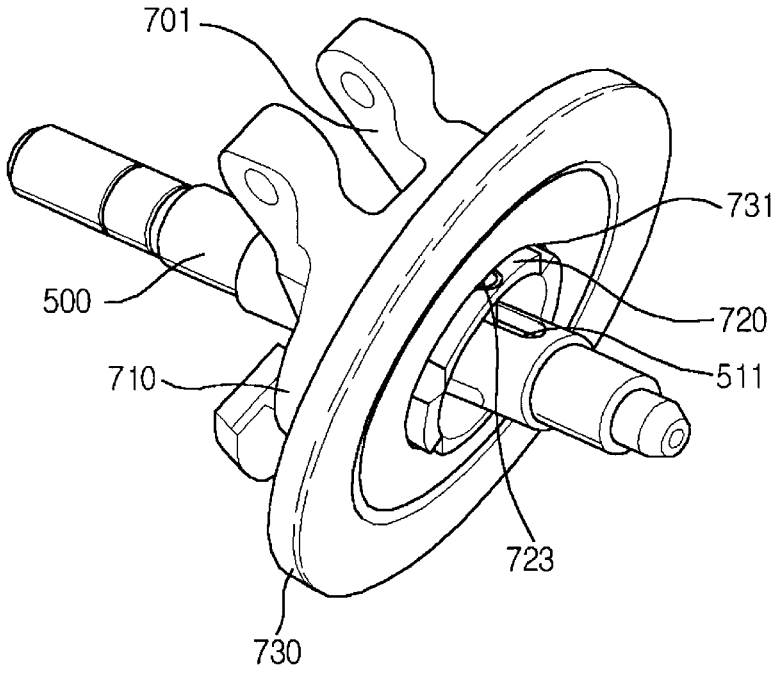
FIG. 5 is a perspective view illustrating an assembled relation between the drive shaft and the swash plate assembly shown in FIG. 4.
Figure 6:
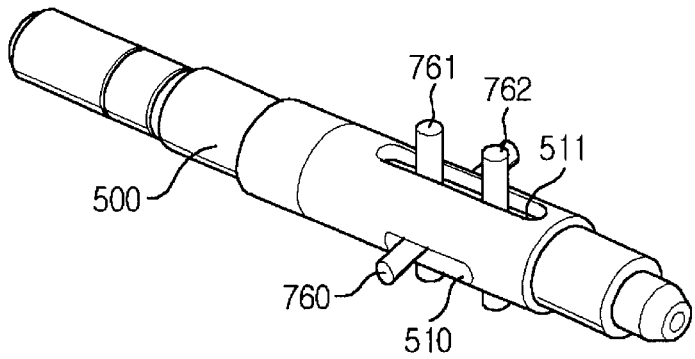
FIG. 6 is a perspective view of the drive shaft shown in FIG. 4 having coupling pins assembled thereto.

FIG. 3 is a sectional view illustrating an internal structure of a variable capacity swash type compressor of the invention, FIG. 4 is an exploded perspective view illustrating a coupling relation between a drive shaft and a swash plate assembly shown in FIG. 3, FIG. 5 is a perspective view illustrating an assembled relation between the drive shaft and the swash plate assembly shown in FIG. 4, and FIG. 6 is a perspective view of the drive shaft shown in FIG. 4 having coupling pins assembled thereto.

Herein, the present invention relates to a coupling structure between a drive shaft and a swash plate assembly. The overall structure of the compressor to which the present invention is applied will be explained before having detailed description about the coupling structure.

As shown in the drawings, the compressor includes a cylinder block 100, a front housing 200, a rear housing 300, a piston 400, a drive shaft 500, a rotor 600, a swash plate assembly 700, a valve unit 800 and a control valve 900.

The cylinder block 100 has a center bore 110 and a number of cylinder bores 120 radially formed around the center bore 100 at the same interval in a front-to-back penetrating manner.

The front housing 200 and the rear housing 300 are mounted respectively on front and rear ends of the cylinder block 100 so that these sub-components are coupled into one unit via an elongated bolt 210.

The piston 400 is arranged slidable into each of the cylinder bores 120, and has a body 410 and a bridge portion 420.

The drive shaft 500 rotatively penetrates a central portion of a front wall of the front housing 200 and extends through a crank chamber 220 within the front housing 200 to rotatively support an rear end thereof to a central portion of the cylinder block 100.

The cylinder block 100 and the front housing 200 define an internal space which functions as a hermetic space and is used as the crank chamber 200.

The rotor 600 is installed around the drive shaft 500 in a front portion within the crank chamber 220 so as to rotate together with the drive shaft 500.

The swash plate assembly 700 is installed in a central portion within the crank chamber 220, adjustable in inclination around the drive shaft 500.

To be more specific, the swash plate assembly 700 rotates together with the rotor 600, connected via a hinge mechanism.

That is to say, a support arm 610 projects outward along the shaft from one side of the rotor 600, and an arm 701 projects outward toward the support arm 610 of the rotor 600 from one surface of the swash plate assembly 700.

The support arm 610 and the arm 701 are mutually connected via a pin 720.

The swash plate assembly 700 is partially inserted with its outer periphery into the bridge portion 420 of the piston 400 in a rotatable manner.

As connected to the rotor 600 and the bridge portion 420 of the piston 400 as set forth above, the swash plate assembly 700 rotates together with the rotor 600 which is rotated by the drive shaft 500 as well as rotates about a pin 620 forward and backward under the internal pressure of the crank chamber 220 so as to enable adjustment of inclination thereof.

In the meantime, the valve unit 800 is installed between the cylinder block 100 and the rear housing 300 to control suction and discharge of refrigerant.

So far it has been described about the overall structure of the compressor to which the present invention is applied.

Hereinafter it will be described in detail about the coupling structure between the drive shaft and the swash plate assembly according to the essential aspect of the invention.

The swash plate assembly 700 includes a hub 710 and a plate 730.

The hub 710 has a through-hole 711 for allowing slidable motion of the drive shaft 500 and a boss 720 having a plurality of pin holes 721, 722 and 723 in an outer periphery thereof.

The swash plate 730 has a coupling hole 731 in a central portion for coupling with an outer periphery of the boss 720, and the piston 400 is installed around an edge portion of the swash plate 730 as shown in FIG. 3.

Herein, the coupling hole 731 of the plate 730 is fixedly coupled to the outer periphery of the boss 720 via screw-coupling or interference fit.

The drive shaft 500 has a plurality of slots 510 and 511 in the axial direction which communicate and intersect with each other and correspond to the pin holes 721 to 723.

The hub 710 and the drive shaft 500 constituting the swash plate assembly 720 are assembled together via a plurality of coupling pins 760 to 762 inserted through the pin holes 721 to 723 and the corresponding slots 510 and 511.

The single pin hole 721 is provided corresponding to one of the slots 510 and 511 so that the single coupling pin 760 may be coupled thereto. On the other hand, the at least two pin holes 722 and 723 are preferably provided corresponding to the other one of the slots 510 and 511 so that the plurality of coupling pins 761 and 762 may be coupled thereto.

In the meantime, the two slots 510 and 511 are provided in the drive shaft 500 to communicate with each other at a right angle.

In addition, when cut in a right angle in respect to the axial direction, the drive shaft 500 is provided substantially in the form of a "cross."

The single coupling pin 760 is placed between the plurality of coupling pins 761 and 762.

In the meantime, the inside surface of the coupling hole 731 of the plate 730 is provided to cover the pin holes 721 to 723 so as to prevent release of the pin holes 721 to 723 from the coupling pins 760 to 762.

The following description will discuss the operation of the invention having the above coupling structure between the drive shaft and the swash plate assembly.

First, when the drive shaft 500 is rotated, the rotating force of the drive shaft 500 is transferred in the following course to rotate the swash plate 730 so that the piston 400 reciprocates in the cylinder bore 120.

This first transfer course continues to the swash plate 730 via a boss 740 which is coupled to the drive shaft 500 with the single coupling pin 760 and the plurality of coupling pins 761 and 762.

Then the second transfer course continues to the swash plate 730 via the boss 740 of the hub 710 which is adjustable in inclination angle via the rotor 600.

The rotating force of the drive shaft 500 is divided along the two transfer courses having the construction where the plurality of coupling pins 761 and 762 are further added so as to fundamentally prevent a side effect that the rotating force of the drive shaft 500 is concentrated to the rotor 600 and reduce the frictional resistance between the drive shaft 500 and the hub 710 facilitating variation in inclination angle.

In the meantime, the swash plate assembly 700 of this invention is capable of accepting the variation range of inclination angle as well as a conventional construction, however, the construction capable of accepting the variation range is different in which the drive shaft 500 has an additional vertical slot 511 for communicating and perpendicularly intersecting with the slot 510 into which the single coupling pin 760 is inserted.

The plurality of coupling pins 761 and 762 are inserted into the vertical slot 511 to shift into inclined positions within the vertical slot 511 when the inclination angle of the swash plate assembly 700 is varied. This can fundamentally prevent twist of the plate 730 of the swash plate assembly 700 owing to compressive load from the piston 400 during actuation of the compressor thereby further stably varying the inclination angle of the swash plate assembly.

Moreover, the construction of the invention in which the vertical slot 511 is formed in the drive shaft 500 while the plurality of coupling pins 761 and 762 are inserted into the vertical slot 511 relieves the necessity of forming the inside configuration of the drive shaft through-hole of the boss or the outside configuration of the corresponding drive shaft into the rectangular cross section thereby reducing cost and enhancing workability.

What is claimed is:

1. A coupling structure between a drive shaft and a swash plate assembly in a variable capacity swash plate type compressor of the type, which is hingeably coupled to one side of a rotor in such a manner that its inclination angle is adjustable, under the rotating force of the drive shaft to reciprocate a piston within a cylinder bore, which comprises:

the swash plate assembly which includes a hub having a drive shaft through-hole for passage of the drive shaft and a boss with a plurality of pin holes on the outer periphery thereof, and a swash plate coupled to the outer periphery of the boss and mounted a piston thereon;

the drive shaft which includes a plurality of slots formed thereon in an axial direction to correspond to the pin holes of the hub, the slots communicating and intersecting with each other; and a plurality of coupling pins inserted into the pin holes and the corresponding slots to couple the swash plate assembly to the drive shaft.

2. The coupling structure between a drive shaft and a swash plate assembly in accordance with claim 1, wherein the pin hole corresponding to one of the slots comprises one pin hole so that the coupling pin is coupled thereto in a single number, and the pin holes corresponding to the other one of the slots comprise at least two pin holes spaced at least for a predetermined interval so that the coupling pins are coupled thereto in plural numbers.

3. The coupling structure between a drive shaft and a swash plate assembly in accordance with claim 2, wherein the single coupling pin is placed between the plurality of coupling pins.

4. The coupling structure between a drive shaft and a swash plate assembly in accordance with claim 2, wherein the slot comprises two slots in the drive shaft, the two slots communicating with each other at a right angle.

5. The coupling structure between a drive shaft and a swash plate assembly in accordance with claim 1, wherein the swash plate covers the pin holes to prevent release of the coupling pins from the pin holes.

* * * * *